United States Patent [19]

Dourdeville et al.

[11] Patent Number: 4,534,659

[45] Date of Patent: Aug. 13, 1985

[54] PASSIVE FLUID MIXING SYSTEM

[75] Inventors: Theodore A. Dourdeville, Southboro; Anthony Lymneos, West Upton, both of Mass.

[73] Assignee: Millipore Corporation, Bedford, Mass.

[21] Appl. No.: 574,541

[22] Filed: Jan. 27, 1984

[51] Int. Cl.[3] ..... B01F 5/06

[52] U.S. Cl. ..... 366/338; 366/341

[58] Field of Search ..... 366/336, 340, 337, 338, 366/339, 341; 521/917; 252/359 E; 138/37, 38, 42

[56] References Cited

U.S. PATENT DOCUMENTS 3,089,683 5/1963 Thomas et al. .
3,323,550 6/1967 Lee .
3,382,534 5/1968 Veazey .
3,459,407 8/1969 Hazlehurst ..... 366/338
3,856,270 12/1974 Hemker .
4,062,524 12/1977 Brauner et al. .
4,087,862 5/1978 Tsien ..... 366/340

*Primary Examiner*—Robert W. Jenkins
*Attorney, Agent, or Firm*—Hamilton, Brook, Smith & Reynolds

[57] ABSTRACT

A passive fluid mixing system having one or more mixers each comprising a mixing chamber (12), a fluid entrance passageway (18) and a fluid exit passageway (20), the passageways being located at opposite ends of the chamber and displaced substantially 180° from each other and lying at least in part in common plane including the axis (13) of the chamber.

12 Claims, 7 Drawing Figures

PASSIVE FLUID MIXING SYSTEM

DESCRIPTION

1. Technical Field

This invention relates in general to static or passive fluid mixing systems and more particularly to such devices which have particular utility in liquid chromatography.

2. Background of the Invention

A liquid chromatograph is an instrument composed of several functional modules. A liquid sample to be analyzed in normally introduced into the system via an injector from which it is forced by a flowing stream of solvent, termed the mobile phase, through a narrow bore transport tube to a column. The column is a larger diameter tube packed with small particles known as the stationary phase.

The sample mixture separated as a result of differential partitioning between the stationary and mobile phases. Thus, as the mobile phase is forced through the stationary phase, a multiple component sample is separated into discrete zones or bands. The bands continue to migrate through the bed, eventually passing out of the column (a process known as elution) and through any one or a number of detectors.

The detector provides input to a recording device, for example, a strip chart recorder. A deflection of the pen or the recorder indicates the elution of one or more chromatographic bands. The recorder tracing from the elution of a single band is called a peak. The collection of peaks which result from an injected sample comprise the chromatogram. Peaks are usually identified by their retention time or volume. Retention time is the time required to elute the corresponding band from the column. To properly identify peaks, an accurate recording device is needed along with a pumping system that will deliver a precise flow rate throughout the separation. The pump accepts solvent (the mobile phase) from an outside reservoir and forces it through the injector where the sample is added to the solvent and thence through the column.

Modern high pressure liquid chromatographic systems often deliver multicomponent mobile phases, that is, mixtures of two or more solvents to the chromatographic column. When the solvent composition remains constant through the duration of the separation, it is called isocratic delivery. However, it is also required from time to time that the composition of the mixture vary over time in a known, well-defined way. For example, it is frequently desired to vary the concentration of one of the components of the solvent mixture as for example water and acetonitrile in the range from 5 to 50 percent over a predetermined period of time. Such time varying compositional changes are termed gradients, and in contrast to isocratic delivery, the process is known as gradient delivery.

A high pressure gradient is created where each solvent is supplied through its own high pressure metering pump, and the mixing ratio at any specified total flow rate is determined by the relative flow rates of the individual pumps. The solvents are brought together and mixed at full chromatographic pressure which can be several thousand pounds per square inch.

One such solvent delivery system designed for producing very nearly constant volumetric delivery employs pairs of pistons driven by non-circular gears as disclosed in U.S. Pat. No. 3,855,129 to Abrahams et al.

However, multiple pumps operating to produce either gradient or isocratic delivery inherently produce some periodic compositional variation in the solvent stream due to the very slight non-uniformity of volume delivery of the pumps during the crossover from one piston's delivery to the other. If for example an ultraviolet absorbance detection system is operated at low wave lengths where the solvents may have high background absorbance, this compositional ripple produces an absorbance variation which interferes with the ability to observe and measure chromatographic peaks. Specifically, this results in undesirable rippling of the detector base line.

Similar problems are found in low pressure gradient systems attributable to the non-ideal characteristics of the valves used to generate the gradient composition.

It is an object of this invention to average these short term solvent variations to produce a smooth detector base line.

Another object of the invention is to produce apparatus which may be tuned for the specific application by the selective use of appropriate mixing devices. By appropriate tuning, the attenuation required to smooth the base line in a specific application can be produced with regard to optimizing other features of the system such as fidelity to the input gradient curve shape which is selected by the operator.

An approach to the solution of this problem was through the use of dynamic mixers located between the pump(s) and the injector. The mixers which were essentially flowthrough high pressure chambers typically of very small volume, where fluid is mixed by the action of a magnetic stirring bar rotated by an electric motor external to the chamber. These are not only complicated mechanisms but expensive. Nevertheless, the mixing within the single chamber through which the solvent flows causes a fixed amount of compositional averaging to take place.

It is, accordingly, another object of this invention to produce a simple effective passive or static mixer which has no moving parts and which is simple to manufacture and maintain.

There are many known static mixers. One type of static mixer is shown in U.S. Pat. No. 3,089,683 to Thomas et al. which is designed specifically for the mixing of viscous fluids or liquid plastics such as an epoxy resin with a liquid catalyst. Separate viscous components are introduced to a chamber within a body and thence further into an inner chamber of circular configuration through small tangentially arranged holes to curl together and partially mix within the inner chamber. Then the partially mixed components pass through an atomizing means comprising a diffuser plate with a plurality of spaced holes which further separate and recombine the mixture. Lastly, the material passes through a diffuser comprising a longitudinally bar machined to produce a series of connected discs which produce a wave-like motion or undulating movement to further mix the components. This mechanism is not only complicated but intended for the mixing of viscous materials at a relatively low rate of speed.

Another static mixer is disclosed in U.S. Pat. No. 4,062,524 to Brauner et al. which is a pipe containing areas of comb-like plates arranged so that the webs of one plate extend crosswise through the slots of the other. The complexity of the interrelated combs produces unswept areas where mixing does not take place.

Another static mixer is shown in U.S. Pat. No. 3,856,270 to Hemker which comprises a series of perforated plates retained in face-to-face fluid tight relationship with opposite faces of each plate having channels which cooperate with each other and plate perforations to repeatedly divide and subdivide a stream of fluid and then re-combine the stream to effect mixing. This apparatus also produces unswept areas where mixing does not take place.

Another plate type device is disclosed in U.S. Pat. No. 3,382,534 to Veazey. This apparatus is not adaptable for the mixing of fluids but more accurately combines a plurality of presumably viscous fluids to produce individual filaments from two or more polymeric compositions of different characteristics. They emerge arranged in an adherent side-by-side relationship where each of the original fluids maintains its visible integrity particularly when they are of different colors. This device in effect, then, is not a mixer.

DISCLOSURE OF THE INVENTION

The invention is embodied in a passive fluid mixing system having one or more mixers comprising a mixing chamber, a fluid entrance passageway, and a fluid exit passageway. The mixing chamber is adapted to receive fluid from the fluid passageway and to produce a net fluid motion through the chamber to the exit passageway. The entrance passageway and the exit passageway are located at opposite ends of the chamber and are non-collinear with the axis of the net fluid motion through the chamber. In other words, they are not in alignment with the direction of the net fluid motion through the mixing chamber. The flow of the fluid entering the chamber is changed by the confines of the chamber such that its momentum superimposes upon the net fluid flow pattern of motion which is dominated by paired counter-rotating vortices. The passageways are located at opposite ends of the chamber and displaced substantially 180° from each other and lie at least in part in a common plane including the axis of the chamber.

A plurality of mixing chambers may be located in a matrix block connected in series so that the fluid is mixed repeatedly. Each mixing chamber in the matrix has the same size mixing chambers connected in series. A plurality of matrices may be connected together in a stack. The matrices are selected from a source of both identical matrices and matrices which differ from each other by the size of their mixing chambers. The stack is selectively assembled from that source whereby the stack may comprise one or more matrices having mixing chambers of the same size or of different sizes. Two or more stacks of mixing matrices may be assembled together in continuous fluid relationship. There are means provided for selectively connecting two or more matrices in a single stack or in both stacks in series relationship whereby the mixing system may be tuned to the specific mixing requirements of the solvents, the concentrations and the characteristics of the apparatus.

The above and other features of the invention including various novel details of construction and combinations of parts will now be more particularly described with reference to the accompanying drawings and pointed out in the claims. It will be understood that the particular fluid mixing system embodying the invention is shown by way of illustration only and not as a limitation of the invention. The principles and features of this invention may be employed in varied and numerous embodiments without departing from the scope of the invention.

BEST MODE OF THE INVENTION

Figure 1:
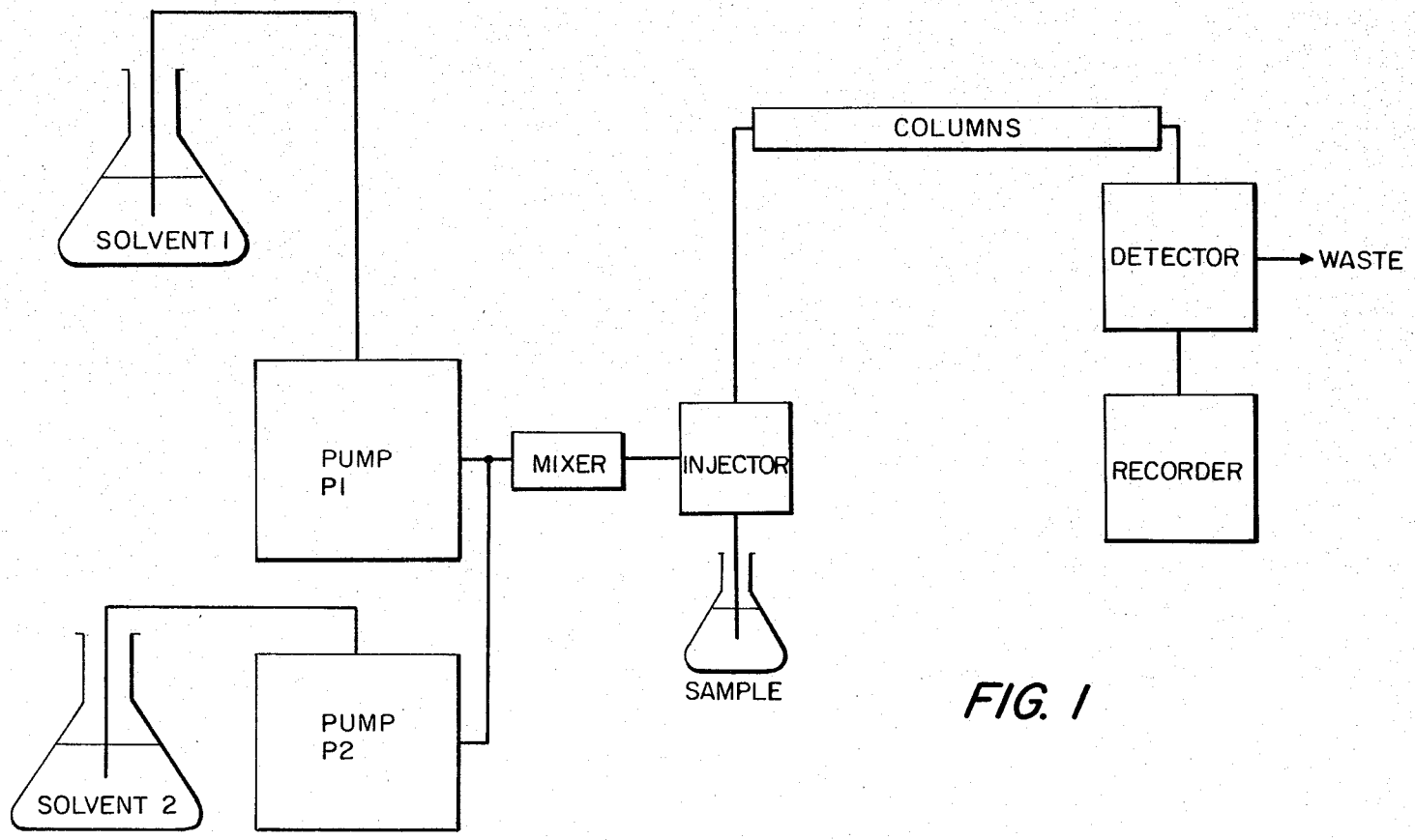
FIG. 1 is a schematic block diagram of the basic elements of a liquid chromatograph.

The conventional components of a two solvent liquid chromatograph are seen in FIG. 1 and include solvent 1 and its pump P1, solvent 2 and its pump P2, a sample, an injector, a column, a detector and a recorder. A mixer embodying features of this invention is located in series between the pumps and the injector.

Figure 2:
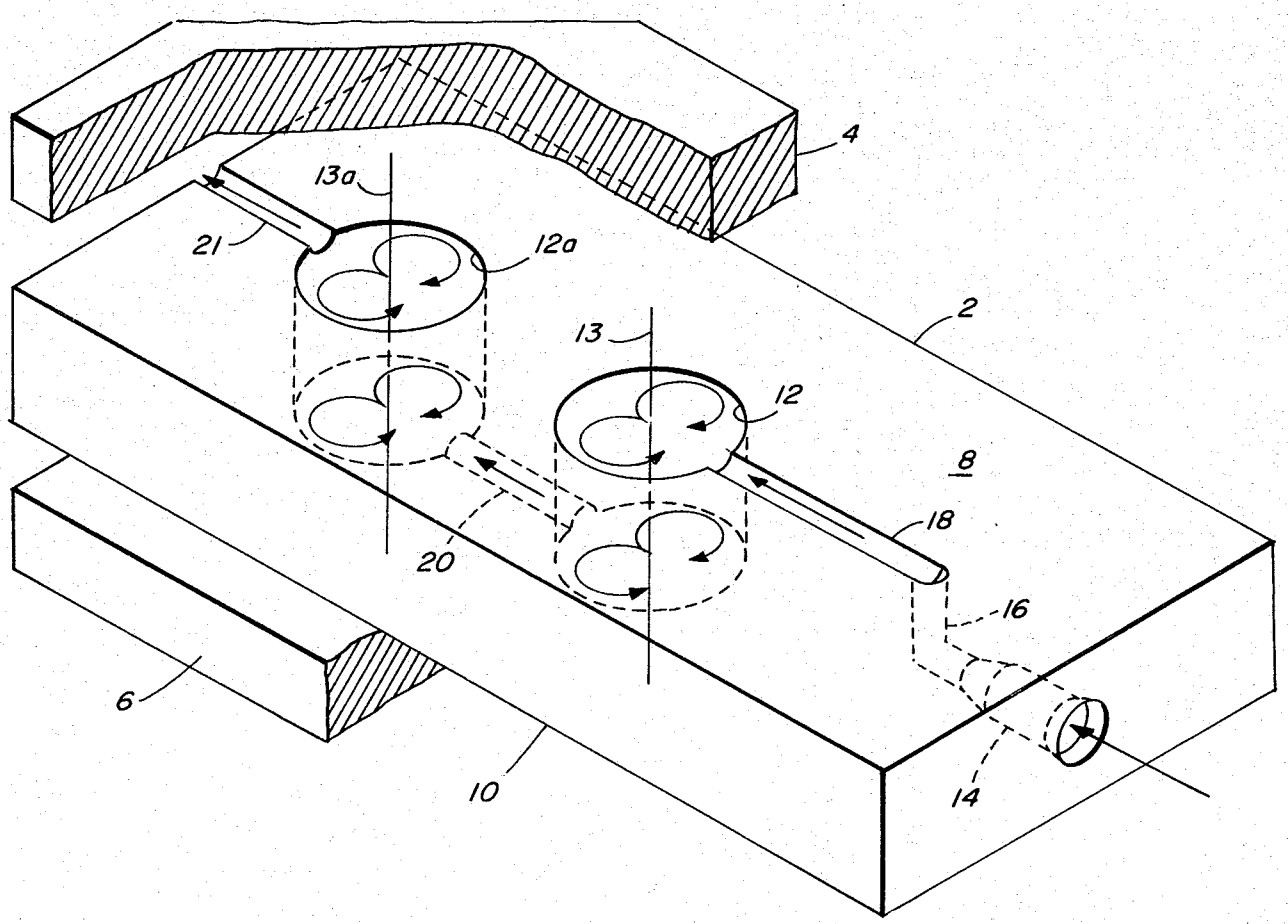
FIG. 2 is a schematic perspective view, with parts broken away, of a portion of a matrix containing two mixing chambers in series and their connecting passageways.

The mixing system includes one or more mixer matrices or stacks of mixer matrices, each matrix containing one or more mixing chambers as will best be seen in FIG. 2. The mixer in its most elementary form comprises a matrix block 2 with a pair of cover plates 4 and 6 shown separated from its opposite parallel planar faces 8 and 10 to which they are normally attached during operation.

Each matrix includes a mixing chamber 12 (which is made by drilling completely through the matrix block 2) and two cover plates 4 and 6. The mixing chamber thus, in this illustrative example, is cylindrical but may assume other configurations such as non-cylindrical or multi-lobar, within the scope of this invention.

The block and the cover plates may be made from any appropriate material; 316 stainless steel having been found to be satisfactory. A fluid entrance conduit 14 at the upper end of the chamber 12 is formed in the block 2 and by way of passageway 16 communicates with a fluid entrance passageway 18 formed in the surface 8 of the matrix block 2. The passageway 18 may be formed by scribing, electrochemical etching or coining, as for example by indenting the surface 8 of the block 2 by a hardened steel wire of the desired dimension.

It should be noted that the cross sectional area of the entrance passageway 18 is essentially semicircular, but if desired a mating semicircular portion could be formed in the undersurface of the block 4 whereby the passageway would in effect be circular in cross section. Other manufacturing techniques can produce geometries other than circular or semi-circular but which are highly acceptable.

It is also to be noted that passageway 18 is of smaller diameter than the entrance conduit 14 whereby solvent under pressure, flowing from the pump into the mixer by way of conduit 14, is accelerated as it flows through the smaller entrance passageway 18.

A fluid exit passageway 20 is located at the opposite or lower end of the chamber 12 in the opposite face 10 of the matrix block 2 and communicates with a second mixing chamber 12*a* which in turn has a fluid exit passageway 21.

The entrance passageway 18 and the exit passageway 20 are located at the opposite ends of the mixing chamber, and they are aligned 180° from each other. Alignment of 180° is optimum, but an alignment of substantially 180° is within the scope of the invention.

The passageways ideally lie in a common plane which includes the axis 13 of the chamber 12. In other words, they lie in a common plane which bisects the chamber along its axis. The exit passageway 20 of the first mixing chamber 12 is also the entrance passageway of the next adjacent mixing chamber 12*a* downstream.

The mixing chamber 12 is adapted to receive fluid flowing at a high velocity from the fluid entrance passageway 18 and to produce a net fluid motion end-to-end through the chamber to the exit passageway 20. The entrance passageway 12 and the exit passageway 20 being located at opposite ends of the chamber are thus non-collinear with the axis of the fluid motion through the chamber which is end to end whereby the flow of the fluid entering the chamber from entrance passageway 18 is changed by the confines of the chamber 12 and its momentum superimposes upon the net fluid motion through the chamber a pattern dominated by paired counter-rotating vortices indicated by arrows in FIG. 2.

The fluid thus introduced moves in symmetrical, approximately helical paths down through the mixing chamber 12 to emerge at the bottom through exit passageway 20. Thence it moves into the next adjacent mixing chamber 12*a* with the process repeated. However, fluid moves from the bottom of the mixing chamber to the top of the flow out through exit passageway 21.

While the terms "up" and "down" have been used to simplify explanation, the orientation of the matrix blocks and hence the axes of the mixing chambers is immaterial. Furthermore, many matrices may be linked in series limited only by space restrictions.

Figure 3:
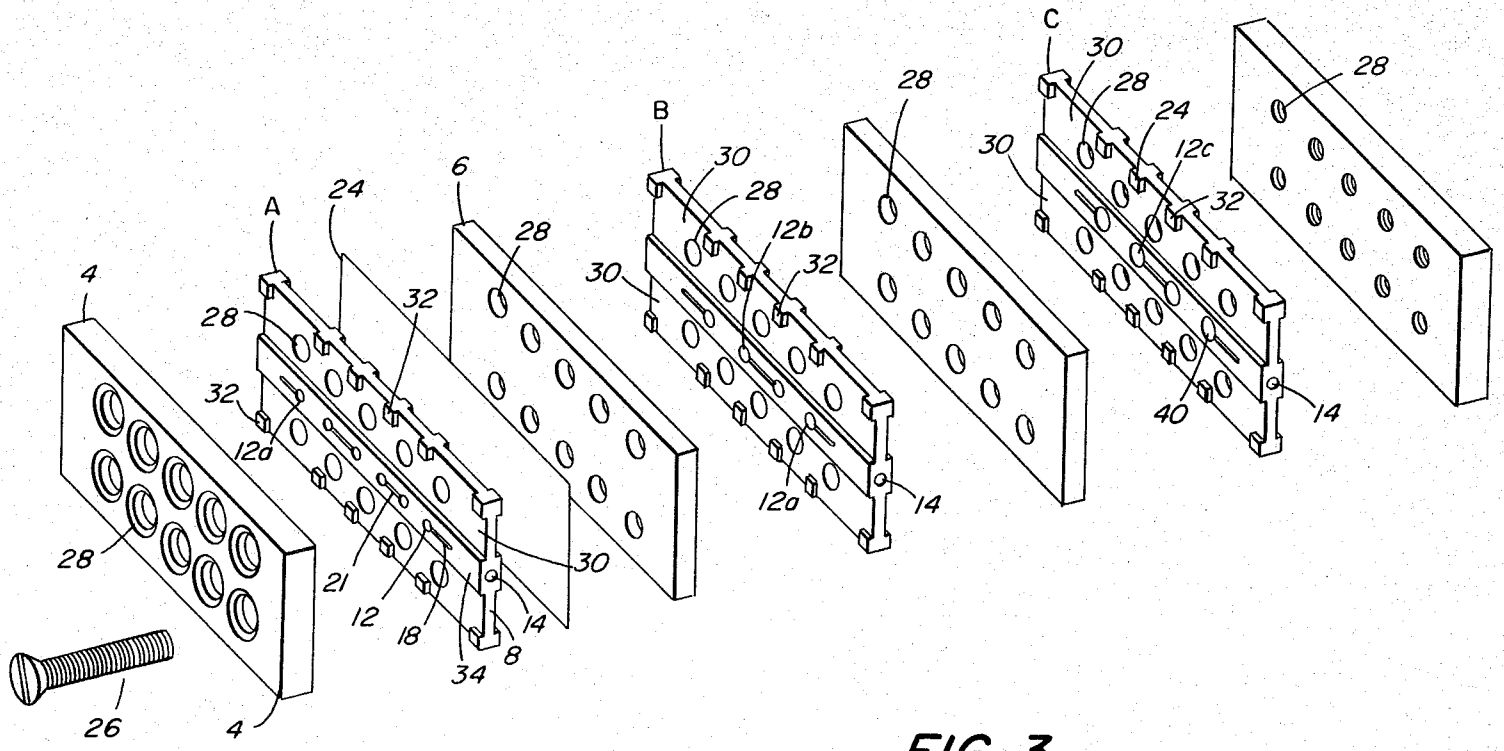
FIG. 3 is a perspective exploded view with parts removed of a mixing system comprising a stack of matrices each in turn having a plurality of mixing chambers in series.

Referring next to FIG. 3, there will be seen an exploded view of a plurality of matrix blocks which, when assembled, are in stacked parallel relationship. A gasket comprising a thin Teflon sheet 24, only one of which is seen in FIG. 3, is placed between each matrix plate and its cover plates. The entire stack is secured together by a plurality of screws 26 which pass through aligned holes 28 formed in each matrix plate and its associated cover plates as well as the gasket but not shown in the gasket.

Because of the very high pressure of the solvent passing through the mixing chambers, the matrices must be secured together under very high pressure, i.e., several thousand pounds per square inch. In order to assure that complete fluid tight contact is made between the matrix blocks and the Teflon gaskets 24, the contact area is reduced by removing a portion of the surface of each matrix block 2, as at 30, leaving a plurality of marginal lands 32 and a centrally located land 34 surrounding the mixing chambers 12 and the entrance and exit passageways 18 and 21.

As will be seen in FIG. 3, there are three matrix blocks in the stack designated respectively A, B, and C. Whereas the mixing chambers 12-12*a* in matrix block A are all of the same diameter, the chambers 12-12*b* in block B are larger and the chambers 12-12*c* in block C are still larger. All mixing chambers in a given matrix block or plate are the same diameter.

With mixing chambers of identical diameter, the time of one revolution of its fluid vortices is constant assuming pressure is constant. The time of retention of fluid within the mixing chamber is then a function of the length of the chamber. With mixing chambers of smaller diameter, the time of a revolution is less than that in a larger diameter chamber. Consequently the mixing characteristics of a mixing chamber are a function of its diameter and/or the thickness of the matrix block which determines the length of the chamber. In the present illustrative example, however, the matrix blocks are all of the same thickness for simplicity of explanation.

It will be understood that for any given stack of matrix blocks, any arrangement of blocks may be employed. For example, three or more blocks A, or three or more B blocks, or three or more C blocks or any combination or multiples of A, B and C may be assembled. For example, two A blocks and one C block may be employed, all depending on the mixing characteristics desired. Furthermore, two or more stacks of matrices may be employed in series. In its most elementary form, a mixer stack would include one each of matrix blocks A, B, and C, each block having in it a series of the same diameter mixing chambers, the diameters varying from block to block.

Examples of means for selectively connecting matrices in series fluid communication will be seen in FIGS. 4 through 7 whereby the mixing system may be tuned to the specific mixing requirements of the solvents, the concentrations and the characteristics of the apparatus.

Figure 4:
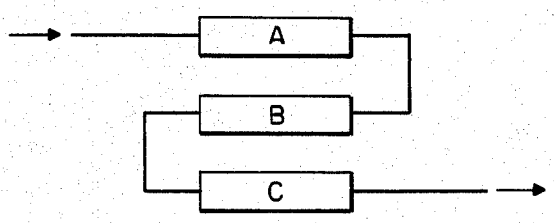
FIGS. 4 through 7 are schematic block diagrams showing mixer matrices connected by fluid conduits and valves for selectively employing one or a plurality of matrices to tune the apparatus.

FIG. 4 shows a stack comprising one each of matrix blocks A, B, and C connected in series by fluid conduits.

Figure 5:
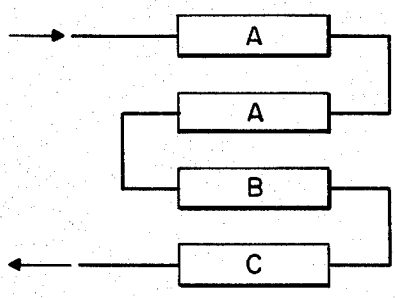

FIG. 5 shows a stack of matrix blocks comprising two A blocks in series with each other and in series with one each of B and C size blocks.

Figure 6:
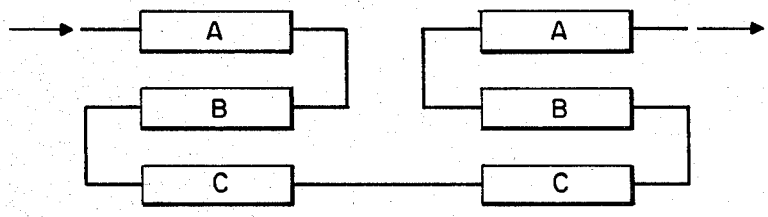

FIG. 6 shows two stacks of one each of A, B, and C blocks connected in series. Similarly there could be more than two stacks in series and/or the stacks may vary as to the composition of matrix blocks.

Figure 7:
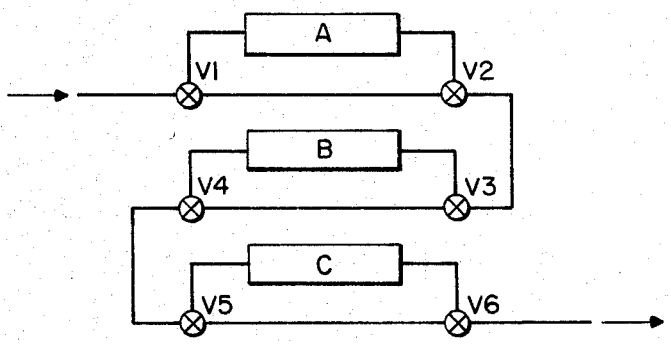

FIG. 7 shows one stack having one each of A, B, and C size matrix blocks joined together in series but in addition having shunt fluid connections whereby one matrix block may be employed exclusive of the other two or two blocks may be employed in series exclusive of the third. In operation, solvent entering from the left as viewed in FIG. 7 reaches three way valve V1 which is pre-set to direct solvent through matrix block A or to shunt it directly to valve V2. Valve V2 is set to direct fluid coming either from block A or its shunt to valve V3 and not back through the shunt. Valve V3 is set to direct the solvent through matrix block B or shunt it directly to valve V4 which permits passage of flow from either direction on to valve V5. Valve V5, in turn, is set to pass the solvent through matrix block C or shunt it to valve V6 and thence on to the injector.

Two or more stacks of matrix blocks, as shown in FIG. 6 with the matrices of each combined, as for example in FIG. 7, can be connected together by appropriate fluid conduits and valve whereby two or more matrices of both stacks can be joined in series relationship.

The following example is illustrative of a condition in high-pressure gradient requiring mixing. Assuming a 10% mixture of acetonitrile in water, the water pump will be operating nine times faster than the acetonitrile pump. Hence, over a unit of time there will be nine piston crossovers of the water pump to one piston crossover of the acetonitrile pump. This results in a higher frequency rippling of the baseline at the water pump crossover frequency summed with a low frequency rippling at the acetonitrile pump crossover frequency. The mixer shall be tuned such that its compositional averaging volume is large enough to integrate or average over the volume between acetonitrile pump crossovers. This volume will by definition be large enough to average over the more frequent water pump crossovers. As guidelines in the selection process, the smallest diameter chambers are employed to attenuate higher frequency rippling with very little delay in system response time. Larger chambers are invoked when it becomes necessary to average over the successively larger volumes when pumps are operated at a slower crossover frequency.

Having thus described our invention, what we claim is new and desire to secure by Letters Patent of the United States:

1. A passive fluid mixer comprising:

a cylindrical mixing chamber, a fluid entrance passageway, a fluid exit passageway, the mixing chamber being adapted to receive fluid from the fluid entrance passageway and to produce a net fluid flow through the chamber to the exit passageway, the entrance passageway and the exit passageway being located at opposite ends of the cylindrical mixing chamber and at right angles to the axis of the chamber, the axis of the entrance passageway being an extension of a diameter of the cylindrical chamber to direct the flow of the fluid entering the chamber against the cylindrical wall of the chamber on the opposite side of the axis from that on which the entrance passageway is located whereby the flow is changed by the confines of the chamber such that its momentum superimposes upon the net fluid flow through the chamber a pattern of motion dominated by paired counter-rotating vortices.

2. A passive fluid mixer according to claim 1 wherein the entrance and exit passageways are each contiguous with an opposite end surface of the mixing chamber.

3. A passive fluid mixer according to claim 1 wherein there is an entrance conduit communicating with the entrance passageway, the diameter of the entrance passageway being smaller than that of the conduit to cause the velocity of the fluid flowing from the conduit into the passageway to be accelerated.

4. A passive fluid mixer comprising a cylindrical mixing chamber, a fluid entrance passageway, a fluid exit passageway, the passageways being located at opposite axial ends of the cylindrical chamber and displaced radially substantially 180° from each other and lying at least in part in a common plane including the axis of the cylindrical chamber, whereby the flow of the fluid entering the cylinder from the entrance passageway is directed against the cylindrical wall of the chamber to create fluid motion within the cylindrical moving from one end of the chamber to the other and dominated by paired counter-rotating vortices.

5. A passive fluid mixer according to claim 4 wherein the entrance and exit passageways are each contiguous with an opposite end surface of the chamber.

6. A passive fluid mixer according to claim 4 wherein there is an entrance conduit communicating with the entrance passageway, the diameter of the entrance passageway being smaller than that of the conduit to cause the velocity of the fluid flowing from the conduit into the passageway and thence into the mixing chamber to be accelerated.

7. A passive fluid mixer comprising:

a matrix block, a plurality of cylindrical mixing chambers in the block connected in series, each chamber having:

a fluid entrance passageway, a fluid exit passageway, the passageways being located at opposite axial ends of the cylindrical chamber and displaced radially substantially 180° from each other and lying at least in part in a common plane including the axis of the cylindrical chamber, the exit passageway of one chamber being the entrance passageway of the next adjacent chamber downstream, whereby the flow of the fluid entering each successive chamber from the entrance passageway is directed against the cylindrical wall of the chamber to create fluid motion within each chamber moving from one end of the chamber to the other and dominated by paired counter-rotating vortices.

8. A passive fluid mixer according to claim 7 wherein the entrance and exit passageways are each contiguous with an opposite end surface of the chamber.

9. A passive fluid mixer according to claim 7 wherein there is an entrance conduit communicating with the entrance passageway of the first mixing chamber, the diameter of the entrance passageway being smaller than that of the conduit to cause the velocity of the fluid flowing from the conduit into the entrance passageway to be accelerated.

10. A passive fluid mixer comprising:

a stack of mixing matrices, each matrix having a series of the same size cylindrical mixing chambers connected in series, each mixing chamber having a fluid entrance passageway and a fluid exit passageway located at opposite ends of the chamber being displaced 180° from each other and lying in part in a common plane including the axes of the cylindrical chamber, a source of both identical matrices and matrices which differ from each other by the size of their mixing chambers, the stack being selectively assembled from said source, whereby the stack may comprise one or more matrices having mixing chambers of the same size or of different sizes.

11. A passive fluid mixer according to claim 10 in which there are means for selectively connecting two or more matrices in series relationship.

12. A passive fluid mixer according to claim 10 in which there are two or more stacks of mixing matrices and means for selectively connecting two or more matrices of both stacks in series relationship.

* * * * *